US009193579B2

(12) United States Patent
Brugger et al.

(10) Patent No.: US 9,193,579 B2
(45) Date of Patent: Nov. 24, 2015

(54) DISPENSER

(75) Inventors: Gerhard Brugger, Pflach (AT); Anton Brugger, Marktoberdorf (DE)

(73) Assignees: Gerhard Brugger, Pflach (AT); Anton Brugger, Marktoberdorf (DE)

( * ) Notice: Subject to any disclaimer, the term of this patent is extended or adjusted under 35 U.S.C. 154(b) by 0 days.

(21) Appl. No.: 13/531,452

(22) Filed: Jun. 22, 2012

(65) Prior Publication Data

US 2013/0075428 A1 Mar. 28, 2013

(30) Foreign Application Priority Data

Jun. 24, 2011 (DE) ..... 20 2011 102 452 U

(51) Int. Cl.
*B67D 7/06* (2010.01)
*B05B 11/00* (2006.01)

(52) U.S. Cl.
CPC ..... *B67D 7/06* (2013.01); *B05B 11/3011* (2013.01); *B05B 11/3073* (2013.01); *B05B 11/3083* (2013.01)

(58) Field of Classification Search
CPC ..... B05B 11/3057
USPC ..... 222/136, 135, 145.1, 145.7, 383.1, 282, 222/283, 285, 286, 295, 303, 309
See application file for complete search history.

(56) References Cited

U.S. PATENT DOCUMENTS

| | | | | | |
|---|---|---|---|---|---|
| 4,355,739 | A * | 10/1982 | Vierkotter | ..... | 222/134 |
| 5,009,342 | A * | 4/1991 | Lawrence et al. | ..... | 222/136 |
| 5,152,431 | A * | 10/1992 | Gardner et al. | ..... | 222/136 |
| 5,192,007 | A * | 3/1993 | Blomquist | ..... | 222/376 |
| 5,353,964 | A * | 10/1994 | Liu et al. | ..... | 222/134 |
| 5,398,846 | A * | 3/1995 | Corba et al. | ..... | 222/1 |
| 5,402,916 | A * | 4/1995 | Nottingham et al. | ..... | 222/134 |
| 5,433,350 | A * | 7/1995 | Graubart | ..... | 222/136 |
| 5,769,275 | A * | 6/1998 | Boehmer et al. | ..... | 222/136 |
| 2012/0132670 | A1 * | 5/2012 | Finlay et al. | ..... | 222/1 |

* cited by examiner

*Primary Examiner* — Kevin P Shaver
*Assistant Examiner* — Michael J Melaragno
(74) *Attorney, Agent, or Firm* — Venable, LLP; Stefan J. Kirchanski

(57) ABSTRACT

A dispenser provides measured doses of at least two components using a common pump. Each of the components is stored in its own separate container; each of which is connected to the common piston pump through an inlet valve. A metering device is disposed between the inlet valves and the pump chambers. The metering device is rotatable around an axis and controls the volume of each component disposed by either changing to flow rate of the component through its inlet valve or by changing the stroke length of the piston associated with its inlet valve.

6 Claims, 3 Drawing Sheets

DISPENSER

Figure 1:
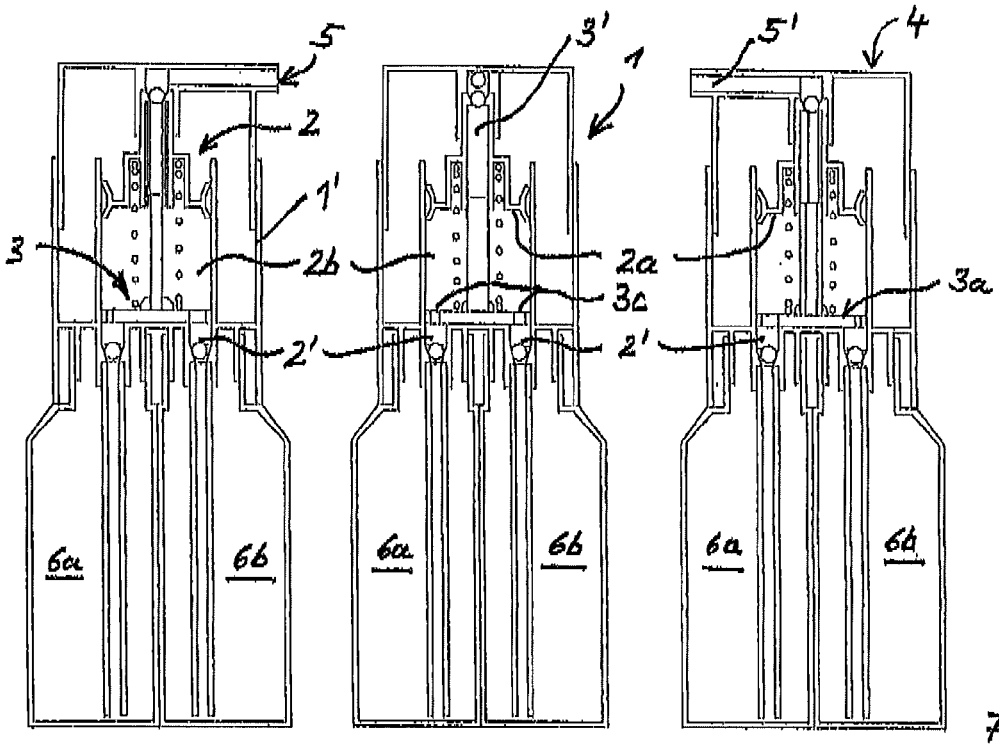

There are known a lot of dosage dispensers, particularly for cleaning agents, which have only one common pump for two components, cf. e.g. U.S. Pat. No. 5,152,461, which configuration and assembly is relative complicated. Further, the metering device with an adjusting knob for squeezing one of the feeding tubes is arranged below the pump, such that the space requirements are rather high. The same applies for a dosage dispenser according to U.S. Pat. No. 5,402,916, wherein the diameter or the length of the flow openings of at least one component is changed, in order to adjust the total ratio of the components to each other, e.g. water to a cleaning concentrate. The adjustment is done with a kind of rotary valve, which is arranged downside of the pumping chamber (pump volume). Thus, the rotary valve moves at each pumping stroke, just as well as the feeding tubes. Because of this operation stroke the required space is also relative high. In addition there is the risk that the feeding tubes are damaged, particularly if the dispenser head is used over years and only the respective container is changed in view of environmental protection.

Thus, it is an object of the present invention to overcome the disadvantages of the prior art and to provide a dosage dispenser that has a simple and compact structure.

Such a dosage dispenser for discharging of a substance consisting of plural components has at least two reservoirs for containing the respective components. The reservoir or container can be a cartridge type, i.e. having a stable casing, or can be formed as a flexible container, so that there are easy to change. Preferably they have a semicircular cross section. The arrangement of the containers also complies with the viscosity of the components and with their output behaviour. Further, there is provided a common piston pump for discharging of the components from the container. The dosage dispenser also comprises a metering device for adjusting the proportion of the components of the substance to dose, wherein the metering device is positioned in a space saving way within the pump volume of the pump and a rotatable metering element is provided for the counter-rotating modification of the discharge cross section or the discharge length, respectively. Thus, there results a simple and easy to assemble structure, characterized by compactness. The inlet valves are fixedly arranged at the wall (cylinder) of the common pump, such that the feeding tubes are not exposed to a bending stress. Thus, compared to the usual construction not only one component is "constricted or choked" in order to change the total ratio, but a counter-rotating dosage is performed, i.e. when the portion of one component is reduced the portion of the second component is raised by the same ratio. This allows a very sensitive adjustment.

Preferably, the metering element is connected in a non-rotation manner (e.g. in form of a four cornered shaft) to the piston and the dispenser head, such that the adjustment of the desired dosage ratio is easily done by turning of the dispenser head. For a simple structure, the metering element includes holes or recesses of different size or a bent slot for changing the flow section and/or the flow length in an easy way. It is also possible to change the cross section of the respective inlet valve by a simple limitation of the respective valve opening.

For further simplification of the structure and thus cheap production of the dosage dispenser the dispenser head (with actuating device or operating handle) and the piston of the pump are formed as one piece, in particular as an injection-molded part. Thus, the dosage dispenser provides only a few elements, which are quickly assembled. The metering element is preferably formed as a flat and thus space-saving metering disk. For the application to a so-called trigger sprayer the metering element can be formed as a metering cylinder with flow openings, that is adjustable via a rear adjusting knob. The metering means in form of one channel for each component are provided here at the periphery of the metering cylinder, which is positioned within the pump volume of the pump. This metering device is easy to adjust and can be actuated by turning with reduced force.

The adjustment of the mixing ratio of the components is done by changing the relative rotating position of the metering element. The components can be mixed at the dispenser head, particularly in a static mixer, or can leave the dispenser head unmixed. Thus, the proposed dosage dispenser has a simple and stable structure and a very compact design. Preferably, actuation is made at the upper area of the dosage dispenser, specifically in form of a push button.

Figure 2:
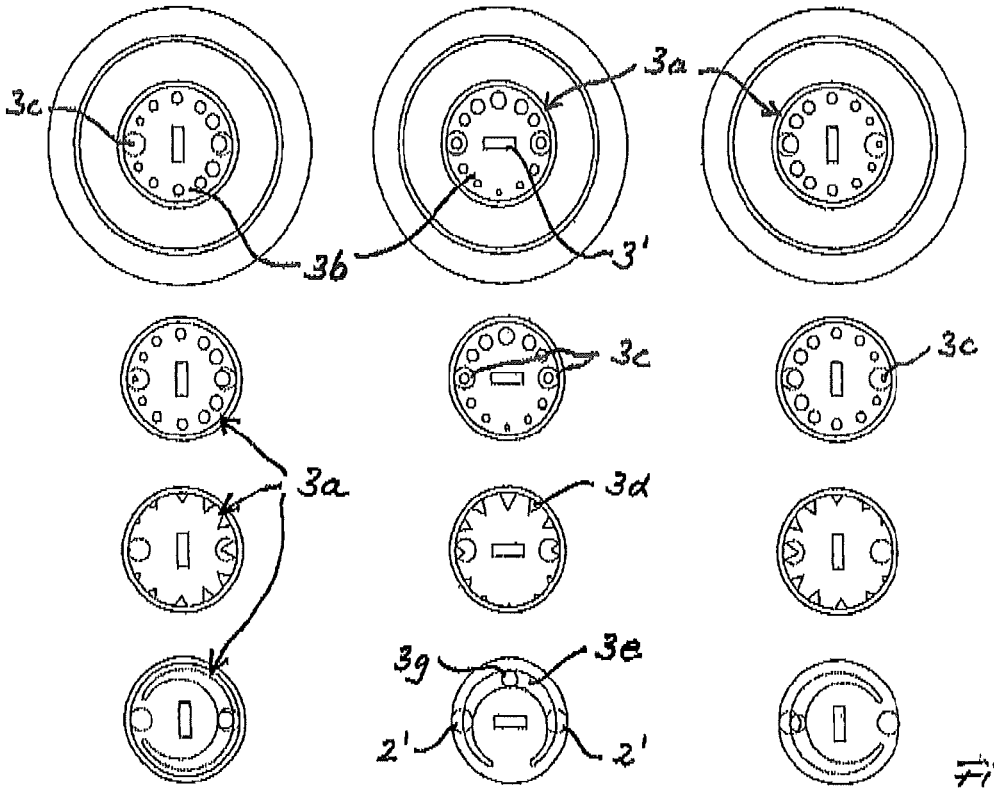
Figure 3:
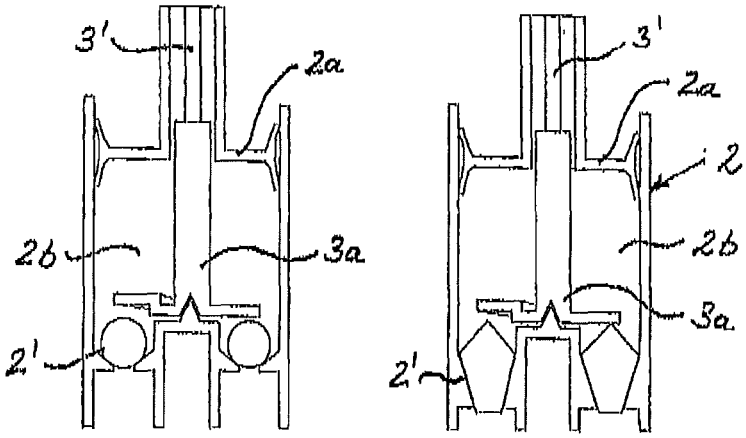
Figure 4:
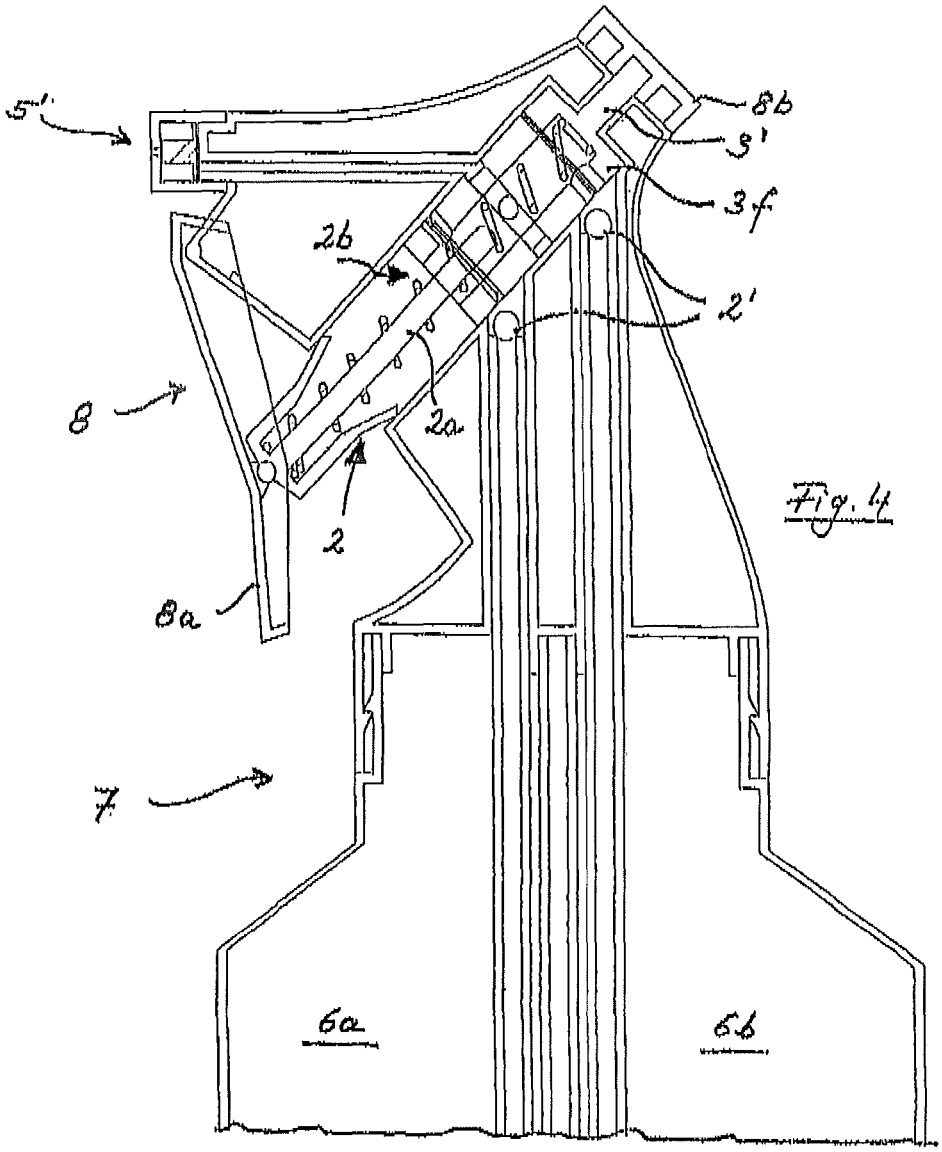
Figure 5:
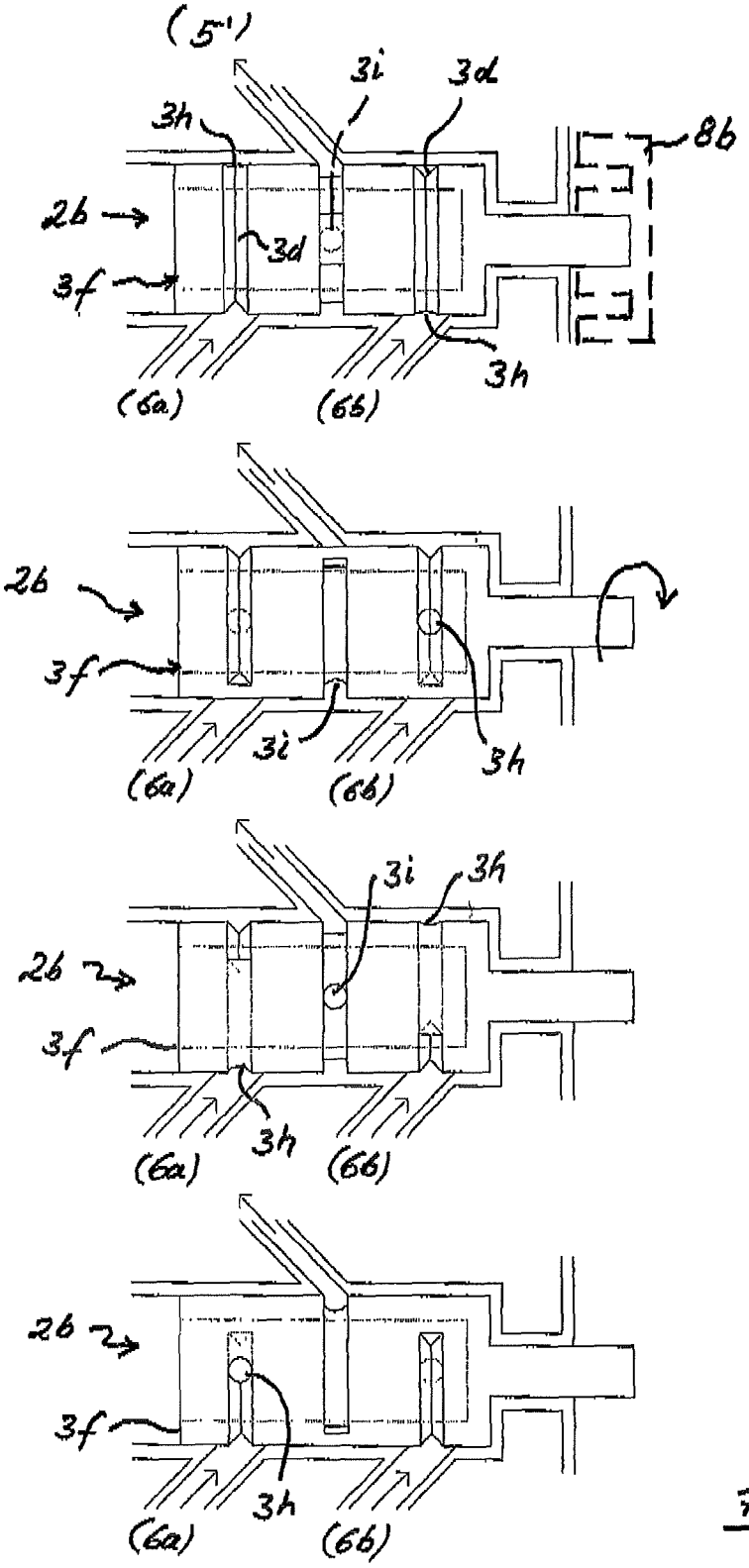

Further advantages, features and characteristics of the invention will be apparent from the following description of preferred, but non-limiting embodiments of the invention, as illustrated with reference to attached schematic drawings:

FIG. 1 shows three sectional views of a dosage dispenser with a metering device, an actuating device and two cartridges (containers) in three different dosage adjustments, FIG. 2 three horizontal cross sections of the dosage dispenser according to FIG. 1 with respectively assigned adjustment disks in various variants, FIG. 3 a modified embodiment of the metering element, FIG. 4 an embodiment of a dosage dispenser as a so-called trigger sprayer with a metering cylinder, and FIG. 5 various metering positions of the metering cylinder of FIG. 4.

FIG. 1 shows three vertical sections of a dosage dispenser 1 with two cartridges 6*a* and 6*b*, each having an inlet valve 2' at the casing to a common pump 2 with a piston 2*a*. The term inlet valve 2' refers to the entrance or suction opening to the pump volume although it is related to the container 6*a*, 6*b* as an outlet. The adjustment of the mixture is done by turning of the metering device 3 around the vertical axis, namely here with the dispenser head 5, as shown in its three metering positions. On pushing an actuating device 4 (here the upper area of the dispenser head 5) the piston 2*a* of the pump 2 is pressed into the pump volume 2*b* and is placed back by a return spring, wherein the components are suctioned via holes 3*c* (or recesses 3*d* etc.) into the pump volume 2*b*. As shown in FIG. 1, the cylinder of the pump 2 and the inlet valves 2' together with the adapters to the container 6*a*, 6*b* are formed as a single element in which the dispenser head 5 with actuating device 4 are guided together with the piston 2*a*. These mentioned elements (5, 4 and 2*a*) are specifically formed as an injection molded part, so that the manufacturing costs and the assembly costs are low. The dispenser head 5 and the dispenser nozzle 5' for discharge of the components belong to the metering device 3 since the twist position of the metering element 3*a*, here a disk is changed via a flattened shaft 3'.

The middle presentation in FIG. 1 shows both holes 3*c* in the metering element 3*a* with equal diameter, whereas the right and left presentations has different diameters because of the twisting of the dispenser head 5 around 90°, each (cf. direction of the dispenser nozzle 5'), if the metering disk 3*b* is twisted by the flat shaft 3' (cf. FIG. 2). The flat shaft 3' extending through the piston 2*a* leaves at least a gap towards the dispenser nozzle 5', such that the components can be discharged from the pump volume 2*b* (cf. FIG. 3, as well).

FIG. 2 shows the various dosage positions, wherein the middle is a 50-to-50%-position as both holes 3*c* located above the two inlet valves 2' have equal diameters. On twisting the metering element 3*a* via the flat shaft 3' around 90°, here the left position, the smallest hole 3*c* in the metering element 3*a* is above the left container 6*a* and its valve 2', such that a smaller volume is discharged compared to the right container 6*b*, e.g. 10% of the total volume from the left container 6*a* and 90% from the right container 6*b*. If the metering device 3 is then turned via the dispenser head 5 around 180° in the vertical axis into the right position, respectively 90° compared to the middle position, the delivery volumes from both containers 6*a* and 6*b* are vice-versa, i.e. about 90% of the total volume are from the container 6*a* and only 10% from the container 6*b*, having now the smallest hole 3*c* located above. The same function is achieved by differently sized recesses 3*d* at the periphery of the metering element 3*a* (shown in the last but one line in FIG. 2), which is here formed as a flat metering disk 3*b*, as well.

The same applies for a sickle-shaped slot 3*e*, shown at the bottom of in FIG. 2, that cooperates with a transfer opening 3*g*. In the middle position the components from the respective valves 2' have the same lengths to the transfer opening 3*g*. By turning around 90°, e.g. into the left position, here, one component is cut (here of container 6*a*) while the other component (here of container 6*b*) can flow from the valve 2' to the transfer opening 3*g*. In the right position the ratio is vice-versa, whereas each ratio between these extremes (e.g. 25-to-75% by turning of the metering element 3*a* around 45°) can be adjusted. As the slot 3*e* narrows with its sickle-shape a combination of the change of the flow section and the flow length results, also depending on the viscosity of the respective components.

FIG. 3 shows a modified form of the metering element 3*a* that is again adjusted by a flat shaft 3'. Above both inlet valves 2' there's a chute in form of a thread or worm such that the balls of the inlet valves 2' can be opened in a different stroke. The same applies for the right alternative in which the balls of the inlet valves 2' are replaced by conical elements. If the metering device 3 is turned via the flat shaft 3' around 180° compared to the position shown in FIG. 3 and the actuating device 4 is pressed downwards, a contrariwise position of the metering element 3*a* above the inlet valves 2' results, so that the flow cross section on the right side would then be e.g. 90% of total delivery volume whereas on the left side only a flow rate of ca. 10% would be discharged. Usually a middle position is pre-adjusted such that the same volume is delivered from both containers 6*a* and 6*b*. Thus, the ratio at the dispenser head 5 contains the same portions of both components. Intermediate positions of the metering device 3 between the aforementioned positions provide respective ratios so that these are changeable for each component between 0%:100% and 100%:0%. For adjusting the mixing ratio in a very simple manner the cylindrically formed dispenser head 5 is turned as shown in FIG. 1, whereas a separate adjusting knob 8*b* is provided for adjustment in a so-called trigger sprayer dispenser 7, as subsequently described.

FIG. 4 shows a sectional view of a trigger sprayer 8 with an actuating lever 8*a*, that acts on a piston 2*a* or piston rod of the pump 2. The piston 2*a* is guided in the interior of a metering cylinder 3*f*, such that, as explained above, the metering element 3*a* of the metering device 3, here in form of the metering cylinder 3*f* is arranged within the pump volume 2*b* and can be turned via the adjusting knob 8*b*. Some of the different turning positions of the metering cylinder 3*f* are shown in FIG. 5. As shown, the suction pipes of the containers 6*a*, 6*b* and their inlet valves 2' are directed to the periphery of the metering cylinder 3*f*. The periphery of the metering cylinder 3*f* has recesses 3*d* or peripheral slots for the components from the containers 6*a* and 6*b*, being twisted against each other on the periphery, such that the suction amount from the containers 6*a*, 6*b* can be varied in order to adjust the total ratio discharged to the dispenser nozzle 5' via an exit port 3*i*.

In FIG. 5 two recesses 3*d* are twisted on the periphery of the metering cylinder 3*f* and flow openings 3*h* to the pump volume 2*b* are shifted around 180°. In the topmost illustration the right flow opening 3*h* in the recess 3*d* is directed to the container 6*b* (or its valve 2'), while the left flow opening 3*h* is in an opposite direction and distanced to the container 6*a*. Thus, a stroke of the pump 2 will convey a larger amount from container 6*b* than from the container 6*a*, e.g. in the ratio 80% to 20%, since the component from the container 6*a* has to travel a greater distance around the periphery of the cylinder 3*f*. In the following position below (turning by 90° as indicated by arrow) both recesses 3*d* or periphery slots are closed towards the container 6*a* and 6*b* such that conveying is not possible and the dispenser is closed. The same applies for the exit port 3*i* in order to avoid an evaporation, in particularly of cleaning agents with alcohol content or to obviate a removal in order to protect children.

At the following position below the ratios are contrariwise to the topmost in FIG. 5, i.e. there's a larger amount is discharged from the container 6*a* than from the container 6*b*, as the component from the container 6*a* has the shortest distance via the adjacent flow opening 3*h*. At the bottom position of FIG. 5 both flow openings 3*h* at the periphery of the metering cylinder 3*f* are equally distanced to the container 6*a* and 6*b* such that a balanced conveying of both components (about 50% to 50%) is obtained. As mentioned above, this middle position can be easily changed by twisting of the adjusting knob 8*b* such that the mixing ratio can be adjusted, whereas the prior art usually squeezes a suction hose of one component.

The invention claimed is:

1. A dispenser (1) for dosing of at least two components each contained in a reservoir (6*a*, 6*b*) by means of a common pump (2) having an inlet valve (2') for each component, a pump volume (2*b*) with a piston (2*a*) and a dispenser head (5) for discharging of the components, wherein a metering device (3) is provided for dosage of amount ratios of each component, characterized in that the metering device (3) is arranged so components are suctioned through the metering device (3) into the pump volume (2*b*) of the pump (2) and a metering element (3*a*) is provided for oppositely changing the flow section and/or flow length of the components wherein the metering element (3*a*) is connected to the piston (2*a*) and the dispenser head (5) of the pump (2) in a non-rotating manner and metering is done by turning the dispenser head (5).

2. Dispenser (1) according to claim 1, characterized in that the metering element (3*a*) includes differently sized large holes (3*c*), recesses (3*d*) or a slot (3*e*) for changing the flow section or flow length.

3. Dispenser (1) according to claim 1, characterized in that the flow section of each input valve (2') is varied by limiting the valve opening via the metering element (3*a*).

4. Dispenser (1) according to claim 1, characterized in that the dispenser head (5) and the piston (2*a*) of the pump (2) are formed as one piece.

5. Dispenser (1) according to claim 1, characterized in that the metering element (3*a*) is formed as a metering disk (3*b*).

6. Dispenser (1) according to claim 4, characterized in that the dispenser head (5) and the piston (2*a*) of the pump (2) are a single injection-molded part.

* * * * *